United States Patent [19]

Duncan

[11] 3,991,601

[45] Nov. 16, 1976

[54] FLUID ACTUATED RECIPROCATING TOOL

[76] Inventor: Samuel G. Duncan, 2227 - 60th Ave. SE. Mercer Island, Wash. 98040

[22] Filed: Aug. 13, 1975

[21] Appl. No.: 604,255

[52] U.S. Cl. ..... 72/391; 72/453.02

[51] Int. Cl.[2] ..... B21J 15/34

[58] Field of Search ..... 72/391, 114, 453; 60/533; 92/152

[56] References Cited

UNITED STATES PATENTS

| | | | |
|---|---|---|---|
| 582,839 | 5/1897 | Winans | 60/533 |
| 2,526,956 | 10/1950 | Kugler | 60/533 |
| 3,082,898 | 3/1963 | Bosch | 72/391 |
| 3,254,522 | 6/1966 | Elliott | 72/391 |
| 3,495,330 | 2/1970 | Bruce | 60/533 |
| 3,565,182 | 2/1971 | Teasdale | 60/533 |
| 3,777,540 | 12/1973 | Siebol | 72/391 |
| 3,898,833 | 8/1975 | Richardson | 72/391 |

*Primary Examiner*—C.W. Lanham
*Assistant Examiner*—Gene P. Crosby
*Attorney, Agent, or Firm*—Nicolaas DeVogel

[57] ABSTRACT

A compressed gas hydraulic operated tool for installing pull type fasteners, in which two balanced hydraulic systems reciprocally and sequentially create alternate equal forces in opposite directions through linear interaction, intra-action and reciprocal inverse rhythmic posturing of a series of compressed gas powered and liquid powered pistons.

8 Claims, 1 Drawing Figure

FLUID ACTUATED RECIPROCATING TOOL

BACKGROUND OF INVENTION

1. Field of Invention

Figure 1:
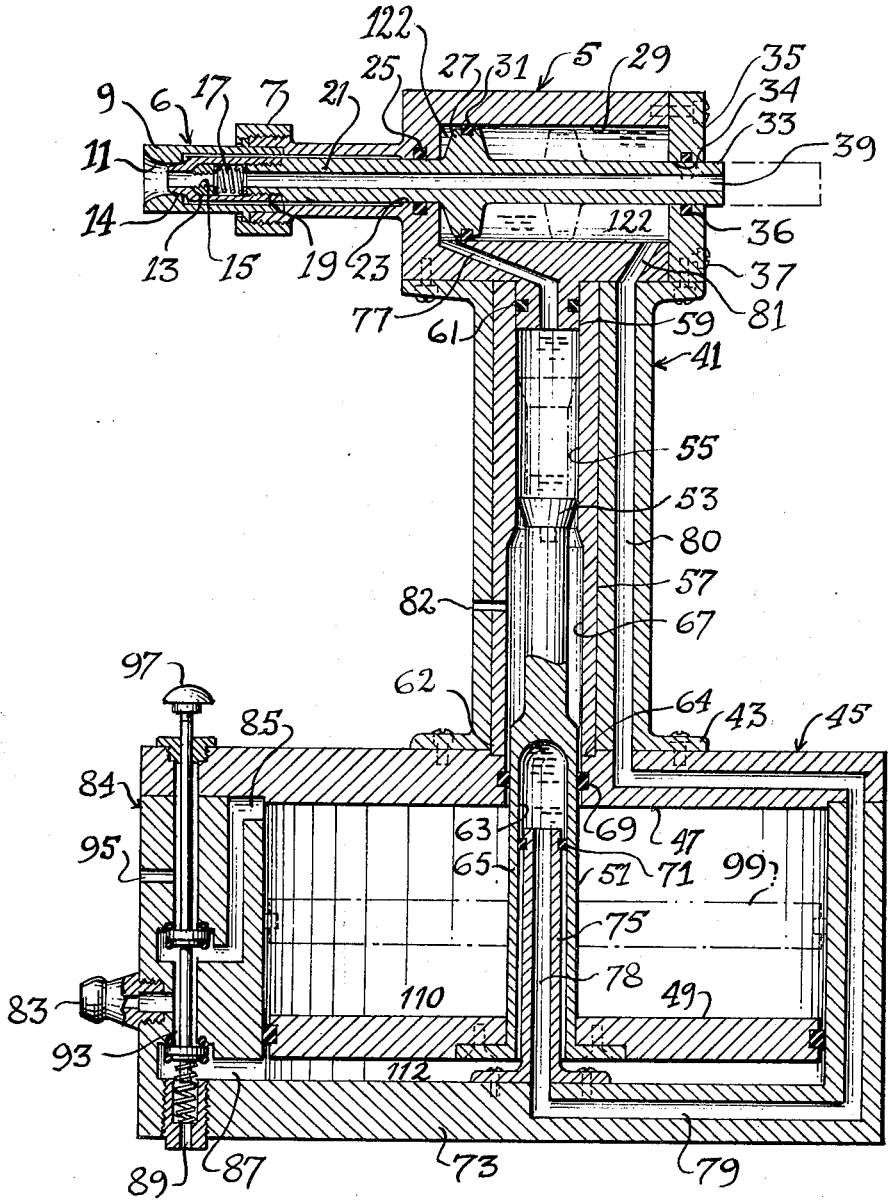

This invention relates to compressed gas-hydraulic and compressed gas pulling tools, and more specifically to an improved compressed gas-hydraulic tool for installing swage locking pins and collars, as well as other pull type fasteners wherein, interaction, intra-action and reciprocal movement of a series of compressed gas and liquid powered pistons create the necessary forces in opposite directions alternately to properly instal the fasteners. This invention can be used for various diameters and styles of fasteners by simply changing the nose assemblies, pulling heads, adapters or attachments compatible with the fastener being installed.

2. Description of Prior Art

Three types of power driven tools are presently being marketed and used to install pull type fasteners. The first, compressed gas-mechanical, are bulky and relatively heavy tools utilizing a compressed gas operated piston to move a wedge upward and downward in such a manner that a lever is activated at a ninety degree angle to the movement of the wedge, operating on a fixed lever shaft. This back and forth movement of the lever applies power to a spindle notched to one end of the lever. Various nose assemblies, pulling heads or compatible adapters secured to the spindle and spindle housing create a condition wherein a fastener may be properly installed. This type of tool has a very rapid cycle, but when operating at maximum load, the mechanical portion requires extensive and frequent maintenance. Even the designer of the tool agrees that it is a device designed to self-destruct. The second type, compressed gas-hydraulic, is much lighter than the compressed gas-mechanical, but most of those in use today are very slow. The push and pull hydraulic systems are powered by an essentially non-compressible liquid from a common reservoir, requiring sophisticated, complicated and troublesome intensifiers valving, and channelling in order to reverse the movement of the head piston to which the fastener adapters are attached. The straight hydraulic pullers operate from either a bulky hydraulic power source or from a small intensifier with low volume. Both systems require two hydraulic hoses from the power source to the tool, creating a handling and access problem for fastener installation. All new developments tend to be improvements on the original systems, such as changing reservoir dimensions, positions, or materials, modifying flow channels, improving gas and liquid components, but none has taken into consideration the specialized embodiments of this invention.

SUMMARY OF INVENTION

The invention in this applicaton now discloses an improved system for installing pull type fasteners. Further, a system is disclosed in which its light weight allows small operators to use the tool continuously without excessive fatigue. Therefore, it is an object of this invention to provide an improved installation tool in which two completely separate and balanced hydraulic systems alternately are activated by injecting compressed gas into a cylinder on alternate sides of a gas piston, causing the gas piston rod and traveling cylinder to act as liquid intensifiers to create the necessary liquid force on the working hydraulic piston in the upper housing member. It is also an object of this invention to utilize a combination piston rod and traveling cylinder connected directly to the gas piston which, when moving in one direction intensifies one of the hydraulic systems by moving over the stationary piston rod mounted in the gas cylinder, one end of the stationary piston rod acts as a stationary hydralic piston within the traveling cylinder.

It is also an object of this invention to provide the above described embodiments and create a tool that requires minimum maintenance.

It is also an object of this invention to provide the above described arrangement and provide a safer tool by reducing the hydraulic pressure to zero when the compressed gas piston is in its reverse maximum positions, and when no load is applied to the upper housing hydraulic piston and piston rods.

It is also an object of this invention to provide the above described embodiments that will be activated with such speed that it will replace the gas-mechaical tool on assembly lines demanding operating speed.

It is also a object of this invention to provide the above described embodiments that can be used with existing nose assemblies, pulling heads, adapters, or attachments compatible with the fastener being installed, thereby eliminating the necessity for the user to discard such tooling presently in inventory.

It is a still further object hereof to provide such an assembly that will allow the broken off portion of the fastener to be fed through an opening in the longitudinal centers of the hydraulic rods and pistons in the upper housing, and be ejected from the cavity in the end of the piston rod opposite that to which the fastener adapter assembly is attached.

It is also an object of this invention to provide the above described embodiment with two distinct and separate balanced hydraulic systems, eliminating the necessity for intricate and delicate valving that could become unbalanced and cause the tool to malfunction.

It is also an object of this invention to provide a tool with the above described embodiments comprising an upper housing member enclosing a hydraulic cylinder which is divided into two chambers by a working hydraulic piston. A tubular piston rod carrying the working piston passes through the first and second chambers. A swaging and installing means is mounted to the upper housng at the first chamber and a slidable sleeve is mounted on the forward end of the tubular piston rod. A base housing is interconnected to the upper housing by means of a holding housing. The base housing contains a gas cylinder which is divided into two gas chambers by a double acting gas piston. Connected to the gas piston is a vertical piston rod, the upper end acting as a driving hydralic piston, the lower end containing a traveling cylinder. The holding housing contains a cylinder bore in which the driving piston reciprocates. The cylinder bore in the holding housing is connected by a passageway to the first chamber of the upper housing. A stationary tubular piston rod is mounted in the base housing in such a manner that it allows the traveling cylinder to move over it. The traveling cylinder bore is connected to the second chamber of the upper housing by passageways in the stationary piston rod, base housing, holding housing and the upper housing. The chamber in the upper housing, the vertical hydraulic cylinder chamber, the chamber in the dead ended shaft, and all of the aforementioned passageways are filled with an incompressible liquid. A reciprocal gas triggering device is mounted on the base housing in such a manner that the pneumatic piston reciprocates within the base housing.

These and other objects and advantages of the present invention will be better understood by referring to the following detailed description taken in conjunction with the accompanying drawing which is explained briefly hereinafter.

In the drawing:

FIG. 1 is a vertical sectional view illustrating the details of construction of a pull type fastener installation tool constructed in accordance with the preferred embodiments of my invention.

DESCRIPTION OF THE INVENTION

When facing the drawing, the left hand side will be referred to as the forward end, while the right hand side will be referred to as the aft.

Referring to the drawing, I have illustrated in FIG. 1 the preferred embodiment of my invention as comprising an upper housing member 5, carrying a swaging and instaling means 6, at the forward end which includes a knurled nut 7, an outer sleeve 9 containing a forming cavity 11. Within the outer sleeve 9 is a slidably mounted sleeve 13. The sleeve 13 encloses serrated sectional members 15 which engage annular grooves around a pulling portion of a fastener, and a compressive material 17 which allows the sectional members 15 to move parallel with the inner surface of sleeve 13.

The sleeve 13 is attached as by means of threads 19 to a tubular piston rod 21, wich passes through a piston rod receiving bore 23 formed in the upper housing member 5, and sealed against liquid leakage by seaing member 25 placed in a suitable recess in upper housing members 5. To the aft end of piston rod 21 there is secured a working piston 27 which is arranged to reciprocate within a hydraulic bore 29 formed in the upper housing member 5. A seal 31 is formed in a suitable recess on the periphery of working piston 27 to prevent liquid leakage from one chamber to another of the two chambers 120 and 122 formed by working piston 27 in cylinder bore 29. Connected to the aft side of working piston 27 and directly opposite the tubular piston rod 21, is a tubular piston rod 33, extending through piston rod receiving bore 34 in hydraulic cylinder bore 29 cover plate 35 and sealed against liquid leakage by a seal 36 placed in a suitable recess formed in aft cover plate 35. Aft cover plate 35 is secured to upper housing member 5 as by means of threaded fasteners 37. Cavity bore 39 extends through entire longitudinal length of tubular piston rod 21, through working piston 27 and through the entire longitudinal length of tubular piston rod 33, allowing the forcably removed portion of the fastener to be ejected from the aft of cavity bore 39.

The upper housng member 5 is secured to a holding housing member or holding device 41 that can be manually grasped, the lower end of which is flanged outwardly as shown at 43 so it may be mounted on an upper gas cylinder closure 45 of the base housing 45 having a gas cylinder 47. Within the gas cylinder 47 there is mounted a double acting gas piston 49 which is secured to a verticaly extending piston rod 51.

The vertical piston rod 51 is secured to a driving hydraulic piston 53 mounted for reciprocation within cylinder bore 55 defined by sleeve member 57. The sleeve member 57 may be positioned by fitting the hydraulic cylinder bore 55 over the external surface of a cylindrical extension 59 of upper housing member 5, surrounded by sealing member 61 placed in a suitable recess to prevent liquid leakage, and fitting the external surface of 62, the opposing terminus of sleeve 57 into a suitable bore 64 in the upper gas cylinder closure 45. The lower section of the piston rod 51 that attaches to the gas piston 49 is hollowed out forming a traveling hydraulic cylinder bore 63 defined by the wall 65, being an extension of piston rod 51. Cylinder bore 67 defined by sleeve 57 is larger than hydraulic cylinder bore 55 to allow the enlarged portion 65 extenson of piston rod 51 to reciprocate within cylinder bore 67 in a non-contact movement. Sealing member 69 is placed in a suitable recess in gas cylinder closure 45 to prevent gas leakage from gas cylinder 47.

Stationary tubular piston rod 75 is secured to closed bottom 73 of gas cylinder 47. Sealing member 71 placed in a suitable recess in stationary tubular piston rod 75 becomes a stationary piston to prevent liquid leakage from hydraulic cylinder bore 63. The upper end of hydraulic cylinder bore 55 is communicated to the forward chamber 120 of hydraulic cylinder bore 29 by passageway 77. The hydraulic cylinder bore 63 is communicated with the aft chamber of cylinder bore 29 by passageways 78, 79, 80 and 81. Passageway 82 communicates cylinder bore 67 to the atmosphere to prevent the occurrence of a gas lock that might prevent the proper reciprocation of piston rod 51. The compressed gas triggering and valving device 84 are not to be considered as a part of this invention, but are shown in common arrangement to cause the proper functioning of the two separate hydraulic systems comprising a part of this invention. The compressed gas triggering and valving device 84 may be any suitable arrangement that allows compressed gas to enter an orifice such as 83 and connects through a passageway such as 85 to the upper chamber 110 of gas cylinder 47 and to exhaust from the bottom chamber 112 of gas cylinder 47 through a passageway such as 87 and orifice such as 89.

When trigger 97 is depressed and the gas valving assembly is in reverse position from that shown in FIG. 1, compressed gas connects to the bottom chamber 112 of gas cylinder 47 through orifice such as 83 and passageway such as 93 and 87, with the exhaust from the upper chamber 110 of cylinder 47 passing through passageways such as 85 and 95.

It will thus be seen that whenever a trigger such as 97 is depressed, the compressed gas piston 49 will be caused to rise to the upper part of compressed gas cylinder 47 as shown in dotted line 99 and that upon release of trigger 97, the compressed gas connections to the compressed gas cylinder 47 will be reversed to drive the compressed gas piston 49 to the down position shown in FIG. 1.

The motion of the compressed gas piston 49 is transmitted to the driving hydraulic piston 53 by means of piston rod 51. The liquid systems comprising the cylinder bores 55, 63 and 29 and passageways 78, 79, 80, 81 and 77 are understood to be completely filled with a suitable hydraulic liquid which is substantially incompressible. It will be noted that the upper limit of the hydraulic piston 53 and the lower limit of hydraulic traveling cylinder bore 63 are determined by the abuttment of the compressed gas piston 49 at the two ends of its cylinder 47.

In operation, the pintail, mandrel or pulling portion of a fastener (not shown) is engaged in the serrations of sectional members 15. Forming cavity 11 rests against the collar that will be swaged to the locking grooves of a pin. When compressed gas piston 49 moves in an upward direction within air cylinder 47, hydraulic driving piston 53 is activated in an upward direction by the piston rod 51. Liquid is forced from chamber 124 of the cylinder bore 55 through passageway 77 into the forward chamber 120 of cylinder bore 29, forcing hydraulic working piston 27 to move into the aft chamber 122 of hydraulic cylinder bore 29. A pulling force is exerted on sectional members 15 encapsulated in sleeve 13 which is attached to tubular hydraulic piston rod 21, an extension of hydraulic working piston 27. Liquid is forced from the aft chamber 122 of cylinder bore 29 through passageways 81, 80, 79 and 78 into chamber in traveling hydraulic cylinder bore 63. The liquid chamber formed by traveling hydraulic cylinder bore 63 increases in volume when cylinder wall 65 moves upward. As the hydraulic working piston 27 moves into aft chamber 122 of hydraulic cylinder bore 29, forward movement of forming cavity 11 is induced causing swaging collar of a fastener to be completely encased in forming cavity 11. Pressure continues to build up in the forward chamber 120 of hydraulic cylinder bore 29 until the pulling portion of a fastener pin is broken off, and left in the cavity 39 of piston rod 21.

When the compressed gas trigger 97 is released, the compressed gas flow is reversed. Compressed gas piston 49 if forced in a downward direction, forcing hydraulic liquid from chamber formed by cylinder bore 63 through passageways 78, 79, 80 and 81 into the aft chamber 122 of hydraulic cylinder bore 29. This reverse pressure forces hydraulic working piston 27 to move with force into the forward chamber 120 of hydraulic cylinder bore 29, pushing liquid from the forward chamber 120 of hydraulic cylinder bore 29 through passageway 71 into chamber 124 in cylinder bore 55. Piston rod 21, an extension of working piston 27 forces the tapered end 14 of sleeve 13 to butt against the swaged collar of the not shown installed fastener in cavity 11, and eject it from cavity 11. Tool is at rest.

Although I have designed the power tool of my invention for use on installing swage locking pins and collars, it is also well suited for any operation where equal and opposite alternate liquid forces are required.

Various other uses and modifications of my invention may be employed without departing from the true spirit and scope thereof and accordingly I do not limit myself to the specific embodiment illustrated or otherwise except by terms of the following claims.

I claim:

1. A tool for installing swage locking pins and collars including a swaging and installing means having swaging means for forming the collar comprising in combination:

a. A pneumatic system including a pneumatic piston for driving a driving piston when activated in one direction and for driving a hollow cylinder when activated in opposite direction, b. said driving piston being part of a first hydraulic system, c. said hollow cylinder being part of a second hydraulic system, d. a working piston and rod assembly adapted to move one way by positive hydraulic liquid pressure of said first hydraulic system caused by said driving piston when driven and said assembly adapted to move the opposite way by positive hydraulic liquid pressure of said second hydraulic system caused by said hollow cylinder when driven, e. said swaging and installing means for swaging a said associated collar about a said associated to be installed pin, actuated by said working piston and rod assembly whereby said swaging and installing operation occurs when said driving piston is driven and whereby after said associated swaged collar is ejected said swaging and installing means is repositioned when said hollow cylinder is driven for a next swaging and installing operation.

2. The tool is claimed in claim 1 wherein said pneumatic piston in said pneumatic system is connected to said driving piston end wherein said hollow cylinder is formed internally in said driving piston so that said pneumatic piston, said driving piston and said hollow cylinder is one part wherein said driving piston has the double function of driving piston and pneumatic piston rod for said pneumatic system.

3. The tool as claimed in claim 2 wherein said pneumatic system is provided with a gas triggering and valving device for switching said pneumatic piston in said one direction and said opposite direction and wherein said device forms part of said tool and said pneumatic system pressure source and associate external power source to be coupled therewith.

4. A tool as claimed in claim 3 wherein said pneumatic system and said gas and triggering device and part of said second hydraulic system are substantially combined into one base housng and wherein part of said first hydraulic system and part of said second hydraulic system are substantially located in a holding housing connected to said base housing and wherein said swaging and installing means and said working rod and piston is contained with part of said first and part of said second hydraulic system in an upper housing, said upper housing being connected to said holding housing so that said upper housing, said holding housing and said base housing forms a one piece portable tool.

5. A tool for installing swage locking pins and collars including a swaging and installing means having a swaging sleeve for forming the collar and a slidable sleeve, serrated segmented sections within said slidable sleeve for engaging pintail stem of said pin, comprising in combination:

a. an upper housing member forming an enclosed hydraulic cylinder which is divided into a first and a second chamber by a movable mounted hydraulic working piston, b. a tubular piston rod passing through said first and second chamber and carrying said working piston, c. said swaging and installing means mounted to said upper housing member adjacent the first chamber and receiving said tubular rod on which said slidable sleeve is connected, d. a base housing, e. a holding housing member interconnecting said upper housing member with said base housing, f. said base housing containing a gas cylinder which is divided into a first gas chamber and a second gas chamber by a double acting gas piston, g. a vertical piston rod having a hollow traveling cylinder formed therein and an integrally connected vertically extended driving piston upon said vertical piston rod, h. said holding housing member forming a cylinder bore in which said driving piston extends for reciprocal movement therein, i. said cylinder bore connected by a first passageway to said first chamber in said upper housing member, j. a stationary tubular piston rod member in said second gas chamber of said base housing and disposed to be received within said hollow traveling cylinder, k. said combined upper, holding and base housing containing a second passageway that interconnects said second chamber via said stationary tubular piston rod with said hollow traveling cylinder, l. first liquid means contained in said cylinder bore, said first passageway and said first chamber forming a first hydraulic system, m. second liquid means contained in second chamber, second passageway, said tubular piston rod and said traveling cylinder, forming a second hydraulic system, n. a gas triggering and valving device connected to said base housing adapted to move said gas piston up or down by associated gas pressure source connected therewith whereby said gas piston in upwards movement will move said driving piston and via said liquid pressure said working piston from said first toward said second chamber thereby pulling said tubular rod and said associated sleeve-pintail engagement so that said collar is swaged about said pin and whereby said continued pressure cooperates to break said pintail and whereby said gas piston in said downwards direction will move said traveling cylinder and said second liquid to move said working piston and said rod from a rearward position toward said first chamber and said slidable sleeve ejects said swaged collar from collar from said swaging cavity, and is in position for reengagement of a next pin and collar assembly operation.

6. A tool as claimed in claim 5 wherein said double acting gas piston is connected to said vertical piston rod for guidance thereof and wherein said gas piston, said vertical piston rod, said driving piston and said hollow traveling cylinder form together one movable positioned part in said tool for moving said gas piston, said first liquid means and said second liquid means simultaneously.

7. A tool as claimed in claim 6 wherein said first and second liquid means are a suitable hydraulic fluid.

8. A tool as claimed in claim 7 wherein said gas triggering and valving device and said double acting gas piston in said gas cylinder are a pneumatic system powered by said associated gas pressure source.

* * * * *